United States Patent [19]

Culling

[11] Patent Number: 4,997,218

[45] Date of Patent: Mar. 5, 1991

[54] PIN LOCK MECHANISM WITH BIAS CHANGE FEATURE

[75] Inventor: Robert K. Culling, Oakland, Mich.

[73] Assignee: The United States of America as represented by the Secretary of the Army, Washington, D.C.

[21] Appl. No.: 468,337

[22] Filed: Jan. 22, 1990

[51] Int. Cl.[5] ..... E05C 5/02

[52] U.S. Cl. ..... 292/60; 292/62; 292/302; 292/DIG. 20; 292/DIG. 47; 292/DIG. 61

[58] Field of Search ..... 292/340, 60, 62, 302, 292/DIG. 20, DIG. 47, 57-59, 61, DIG. 61

[56] References Cited

U.S. PATENT DOCUMENTS

| | | | |
|---|---|---|---|
| 725,662 | 4/1903 | Bohlen | 292/60 |
| 803,335 | 10/1905 | Frisbee | 292/60 |
| 963,997 | 7/1910 | Crowell | 292/340 |
| 1,399,897 | 12/1921 | Singer | 292/340 |
| 1,538,283 | 5/1925 | Gertsfeld | 292/340 |
| 1,706,102 | 3/1929 | Booth | 292/60 |
| 4,066,284 | 1/1978 | Ikemura | 292/62 |
| 4,073,517 | 2/1978 | Bills | 292/60 |
| 4,635,327 | 1/1987 | Netznik | 292/60 X |

FOREIGN PATENT DOCUMENTS

| | | | |
|---|---|---|---|
| 92786 | 9/1871 | France | 292/62 |
| 266960 | 8/1929 | Italy | 292/60 |
| 3776 | of 1890 | United Kingdom | 292/62 |
| 6325 | 3/1914 | United Kingdom | 292/60 |

*Primary Examiner*—Lloyd A. Gall

*Attorney, Agent, or Firm*—Peter A. Taucher; David L. Kuhn

[57] ABSTRACT

Disclosed is a positively locking latch or latch/hinge mechanism for use in applications requiring quick connections and disconnections. The mechanism is comprised of a flange, a pin and base from which a plurality of plate extensions perpendicularly extend. The flange is dimensioned to fit snugly between two of the extensions. The extensions and the flange have axially aligned through holes of equal diameter. The pin axially translates through the aligned holes of the extensions and flange so that the flange is pivotally securable to the base. The diameter of the pin is only slightly less than the diameter of the holes so as to prevent radial movement of the flange relative to the pin axis. The mechanism includes a means for biasing the pin into an engaged position in which the flange is pivotally secured to the base and, alternately, a disengaged position in which the flange is removable from the base.

14 Claims, 8 Drawing Sheets

PIN LOCK MECHANISM WITH BIAS CHANGE FEATURE

GOVERNMENT INTEREST

The invention described herein may be manufactured, used, and licensed by or for the Government for governmental purposes without payment to me of any royalty thereon.

BACKGROUND AND SUMMARY

My invention is a positively locking, quickly releasable latch or combination of hinge and latch. Its applications generally include a wide variety of door-to-door frame connections and window-to-window frame connections. Specific examples of door connections are pickup truck bed, car trailer and garage doors. Similarly, specific examples of window connections include garage, mobile home and boat cabin windows. Other applications for my invention include folding room partitions, lids for containers or compartments, and hatch doors that are hinged to the turret and hull of military tanks. My invention can be applied to any objects which require latch type or hinge type connections.

One problem with some typical hinge mechanisms occurs when the hinged objects are to be disconnected. The connecting parts of such hinge mechanisms may be extremely difficult to disconnect from each other tools are often required to separate them. For example, the pin of the common door hinge can usually only be removed using some sort of tool. A second problem is that partial disassembly of the hinge mechanism is often necessary to separate hinged objects and the disassembled hinge parts can be easily lost or misplaced.

Another problem of some known latch or hinge/-latch devices is that their operation is rather difficult and time consuming. The hinge mechanisms and latches commonly used with sail boat cabin windows illustrate this problem. A cabin window is typically attached to a sail boat hull with one hinge fastened at the top of the window and two or more latches fastened on the sides for locking the window closed. A window latch is usually comprised of a threaded bolt hinged at one end to the hull, and also comprises a threaded handle or wing nut. When the window is closed, the threaded bolt is pivoted into a catch plate integral to the window frame. The threaded wing nut or handle nut is then screwed onto the bolt down toward and against the catch plate thereby compressively locking the window closed. Closing the cabin windows in this fashion is slow since each latch needs the handle nut screwed down so as to lock the window. Slow closure of cabin windows is obviously disadvantageous at the onset of sudden turbulent weather, when it is important that the windows be quickly closed.

To solve the aforementioned problem, two of applicant's locking hinge mechanisms could be substituted for the conventional hinge and latches described above, thereby permitting quick and simple opening and closing of cabin windows. In addition, when placed on opposite sides of the window, my hinge/latch mechanism would allow the window to be opened from either side. Furthermore, my mechanism would permit easy removal of the window for cleaning or repair.

From the foregoing it will be seen that my invention can be used as a latch, a hinge or both on windows, hatch covers, compartment lids, or any removable covering of an access orifice. For any of these applications, my invention permits quick and simple connection and disconnection of the objects to be latched and/or hinged without tools and without diassembly of the hinge mechanism.

DESCRIPTION OF THE DRAWINGS

FIG. 4*a* shows the pin unlocked and biased into the engaged position, and FIG. 4*b* shows the pin locked in the disengaged position.

FIG. 6*a'* is a view taken along line 6*a'*—6*a'* in FIG. 6*a* and FIG. 6*b'* is a view taken along line 6*b'*—6*b'* in FIG. 6*b*.

DETAILED DESCRIPTION

Figure 1A:
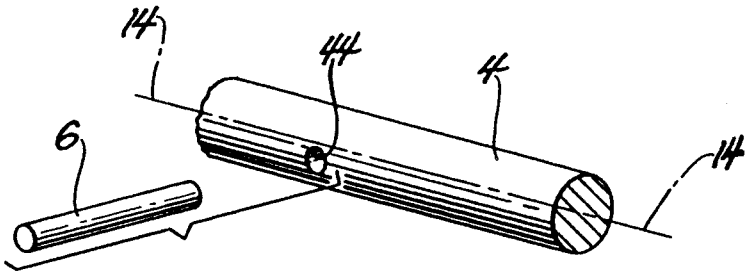
FIG. 1*a* is a detail view of the pin shown in FIG. 1.
Figure 1:
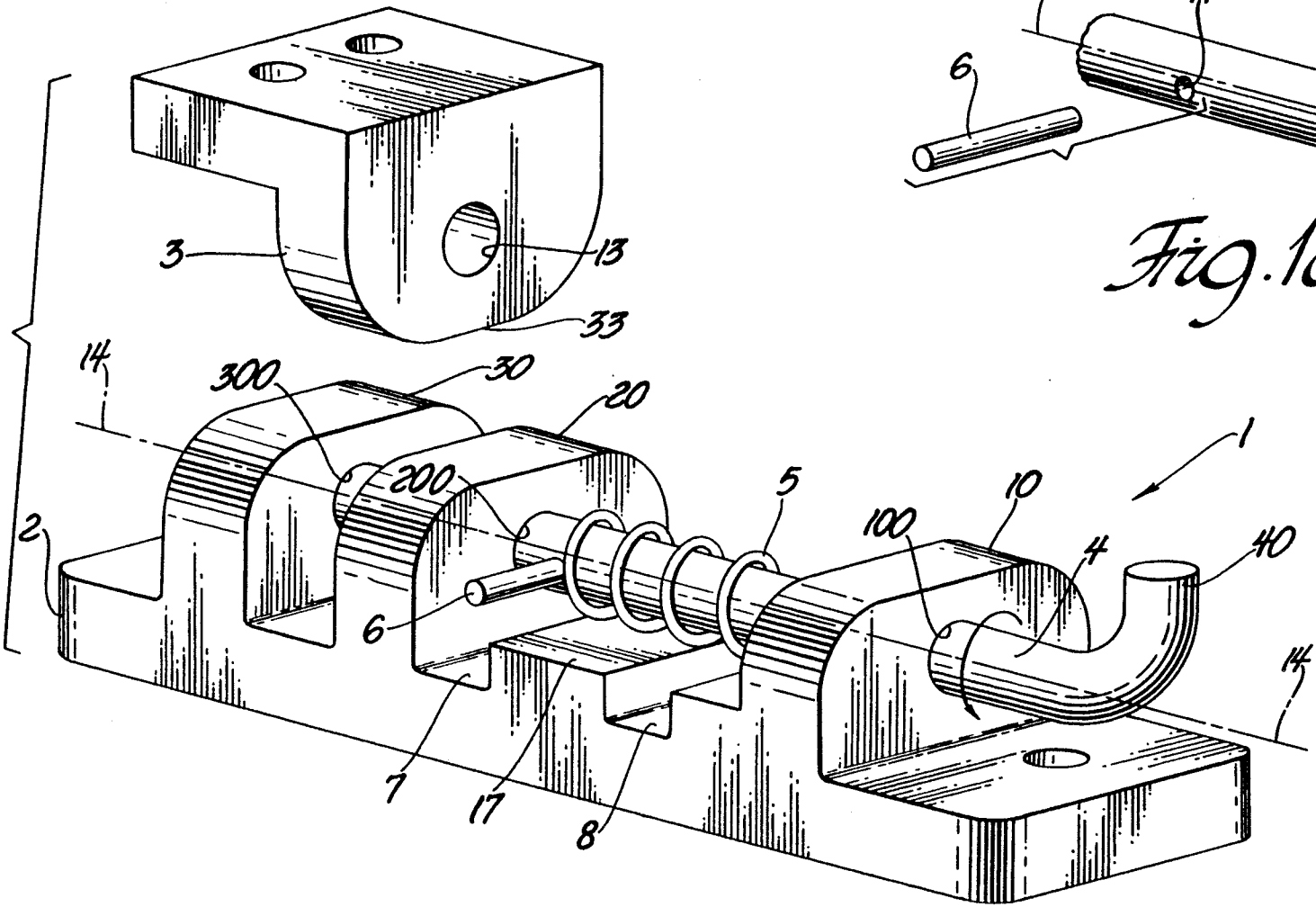
FIG. 1 is a perspective view of my mechanism showing its pin unlocked and biased into the engaged position.

FIG. 1 shows my positive lock, quick release latch or hinge/latch mechanism 1. Mechanism 1 has flange 3 connectable to base 2 by means of axially translatable pin 4. Base 2 mounts to one object and flange 3 mounts to another object. Alternately, the flange and base can be forged or otherwise incorporated into the separate objects.

Extending normally from base 2 are a plurality of transverse ridges or plate extensions (10, 20, and 30), each extension defining a through hole such that the through holes (100, 200, 300) are axially aligned with one another and of equal diameter. Flange 3 is fit between extensions 20 and 30, and has through hole 13 axially alignable with, and of equal or greater diameter to the holes in the extensions. Pin 4 axially translates through the aligned holes of the extensions and flange. Depending upon the shape of flange bottom surface 33, flange 3 either pivotally connects or fixedly connects to the base. If flange bottom surface 33 is rounded as shown in FIG. 1 to a semicircular shape, then flange 3 pivotally connects to the base. On the other hand, if flange bottom surface 33 has a flat rectangular shape that abuts along the entire width of the base between extensions 20 and 30, then flange 3 fixedly connects to the base. The diameter of pin 4 is only slightly less than the diameter of the holes so as to limit radial movement of the flange relative to pin axis 14.

Mechanism 1 includes a means for biasing the pin into a leftward, engaged position (FIG. 1) to hold flange 3 to base 2. Alternately, the pin can be biased toward a rightward, disengaged position so that flange 3 is removable from base 2. The biasing means is coil spring 5 which is concentric with pin 4 and compressed between extensions 10 and 20. As shown in FIG. 1*a*, pin 4 defines a hole 44 perpendicular to pin axis 14 into which dowel 6 inserts and firmly fastens. For some applications, it may be preferred that the dowel protrude equally from the diametrically opposite sides of the pin and protrudes between the coils of spring 5. When spring 5 is compressed between a chosen extension and dowel 6, the spring translates pin 4 away from the chosen extension. Thus, when spring 5 is between dowel 6 and extension 10, the spring forces the dowel away from extension 10 and against extension 20. This sets pin 4 in the engaged position shown in FIG. 1, so that the leftward end of pin 4 protrudes into but not necessarily through hole 300 of extension 30. Rotating pin 4 a quarter turn places dowel 6 into transverse locking slot 7, thereby locking pin 4 in the engaged (leftward) position. In this mode, pin 4 pivotally connects and locks flange 3 to base 2 between extensions 20 and 30.

Figure 2A:
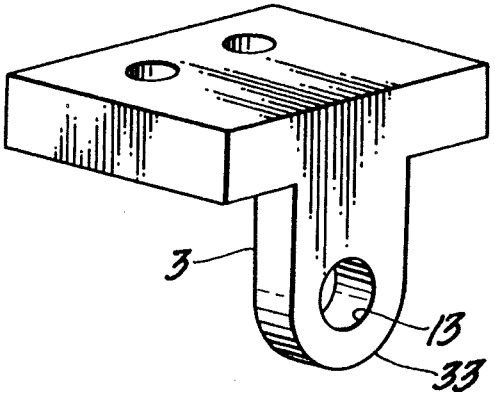
FIG. 2*a* is an alternate flange for my mechanism.
Figure 2:
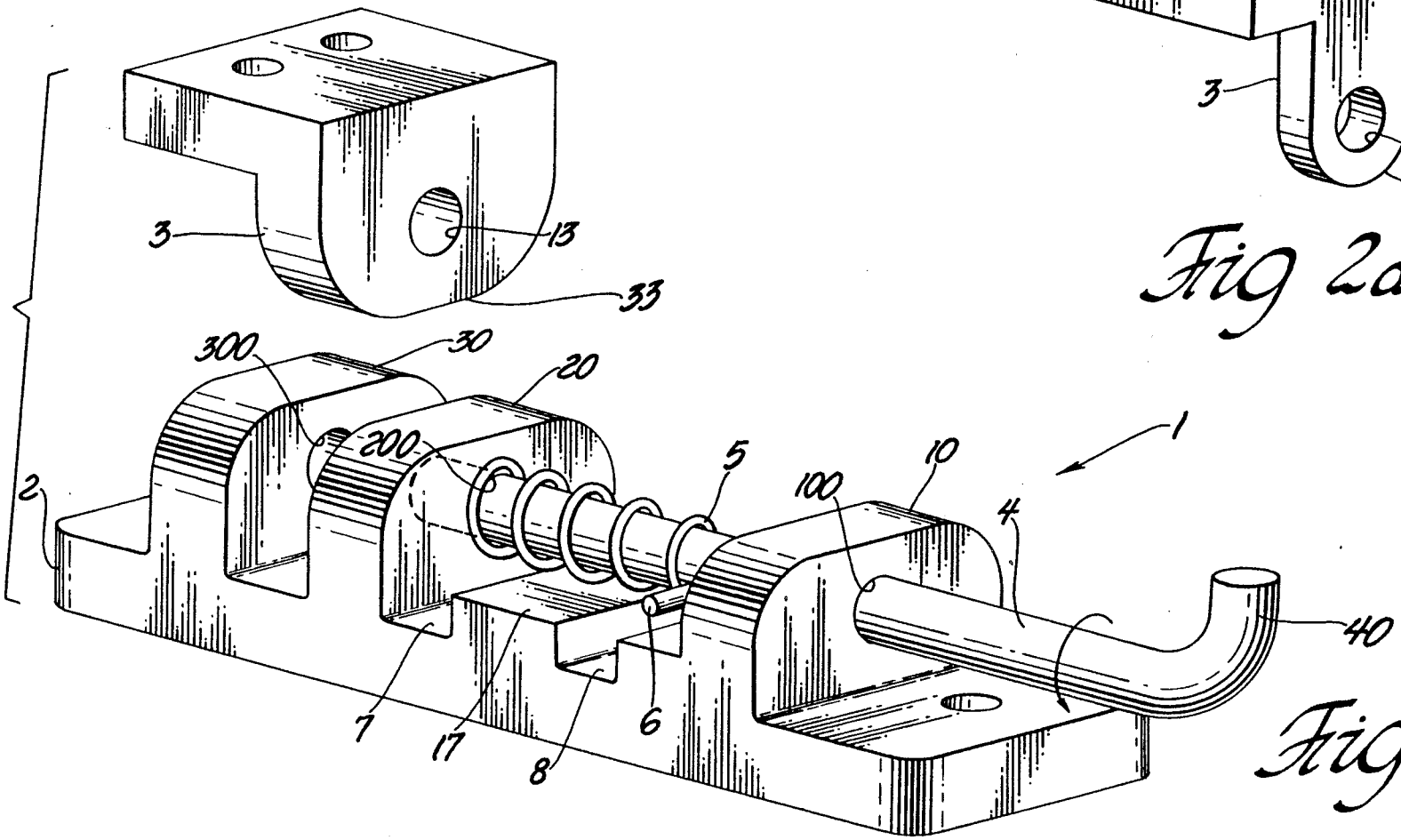
FIG. 2 is a perspective view of my mechanism showing the pin unlocked and biased into the disengaged position.

As illustrated in the FIG. 2 embodiment of my invention, spring 5 can be situated between extension 20 and dowel 6, so that the spring biases the dowel away from extension 20. This sets pin 4 in the disengaged (rightward) position so that the leftward end of pin 4 retracts from hole 300 of extension 30 and resides within hole 200 of extension 20. A quarter turn of pin 4 then rotates dowel 6 into locking slot 8, thereby locking pin 4 in the disengaged position. In this mode, pin 4 no longer pivotally connects flange 3 to base 2.

Figure 3:
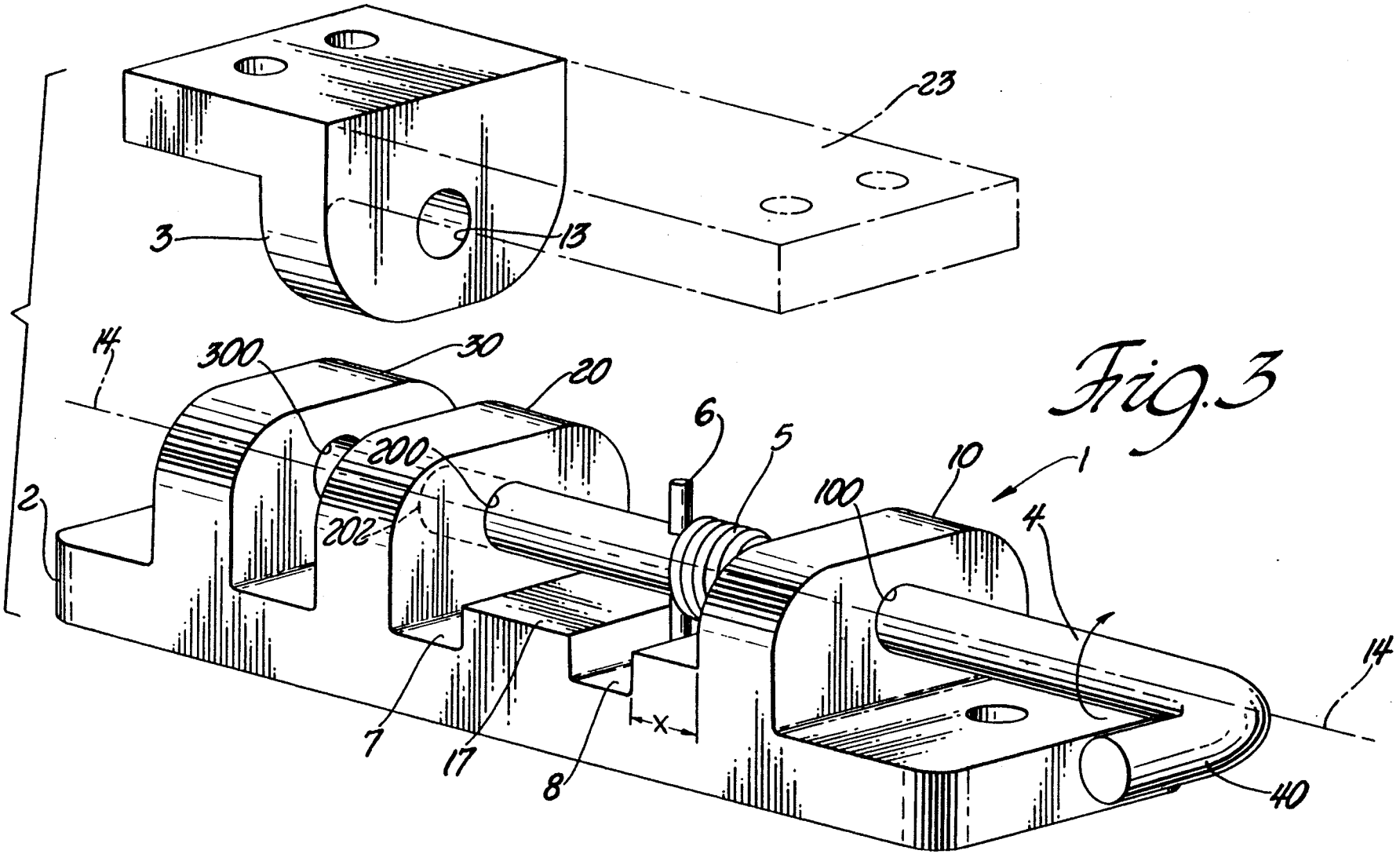
FIG. 3 is a perspective view of my mechanism showing the pin locked in the disengaged position.

Mechanism 1 also permits locking of pin 4 in the disengaged (rightward) position even when spring 5 is situated between dowel 6 and extension 10. Pulling pin handle 40 from the FIG. 1 position against the increasing compressive force of spring 5 retracts pin 4 from hole 300 of extension 30. Once dowel 6 is pulled past protruding stop 17, a quarter rotation of pin 4 places dowel 6 into locking engagement within slot 8. As shown in FIG. 3, dowel 6 then tightly compresses spring 5 in the space between locking slot 8 and extension 10. When spring 5 is so compressed, the leftward end of pin 4 is at point 202 within hole 200 of extension 20 so that the pin is held on axis 14. Holding pin 4 on axis 14 facilitates subsequent leftward translation of pin 4 toward the engaged position by assuring that pin 4 will not hang up on extension 20 or 30.

In the construction shown in FIG. 1, it may be preferred that spring 5 be manually rotatable on pin 4. If the spring is so rotatable, it is possible to change the free, uncompressed position of spring 5 on pin 4. If one rotates spring 5 about pin 4, the coils of the spring interact with dowel 6 so that the spring translates leftward or rightward on pin 4 as seen in FIGS. 1 and 2. As seen in FIG. 1, leftward translation of spring 5 on pin 4 reduces the leftward biasing force that the spring exerts on dowel 6 and pin 4 since fewer coils remain to the right of dowel 6. Continued leftward translation of spring 5 on pin 4 will eventually cause spring 5 to bias dowel 6 and pin 4 to the right in a manner seen, for example in FIG. 2, such that pin 4 is biased to the unlocked position. Obviously, spring 5 can also be rotated to translate it rightward from its FIG. 2 position relative to pin 4, so that one or more coils will arrive at the right side of dowel 6 in FIG. 2.

It should be noted that locking slots 7 and 8 can be situated asymmetrically between extensions 10 and 20, as shown in FIGS. 2 and 3. Locking slot 7 is located immediately adjacent to extension 20 whereas locking slot 8, by contrast, is positioned slightly away from extension 10. The axial dimension "X" (FIG. 3) between locking slot 8 and extension 10 provides space for spring 5 when pin 4 is locked in the disengaged (rightward, flange releasing) position where spring 5 is fully compressed between dowel 6 and extension 10. Optionally, in this disengaged position, the leftward end of pin 4 rests at a point 202 within hole 200 of extension 20. This permits flange 3 to be inserted or removed from between flanges 20 and 30.

It should also be noted that spring 5 is constantly maintained in compression no matter in which mode the hinge mechanism is operated. This prevents unwanted axial and radial oscillation of pin 4 in high vibration environments thereby making the hinge mechanism suitable for low noise applications.

Several features can be incorporated into the design of mechanism 1. For example, extension 30 need not define a through hole at 300. A partially bored hole, or blind bore, is sufficient to retain the leftward end of pin 4 which protrudes into extension 30 when pin 4 is in the engaged position. This protects the leftward end of pin 4 from being accidently hit, thereby preventing unwanted rightward axial movement of pin 4. Furthermore, the blind bore prevents radial movement of pin 4. Another optional feature is expansion 23 shown in phantom lines in FIG. 3. Forged to be an integral part of or otherwise attached to flange 3, the expansion will protect dowel 6 and spring 5 from accidental dislodgement and also add more surface area to flange 3 by which flange 3 could be attached to an object such as a hatch lid or hatch entryway.

Figure 4A:
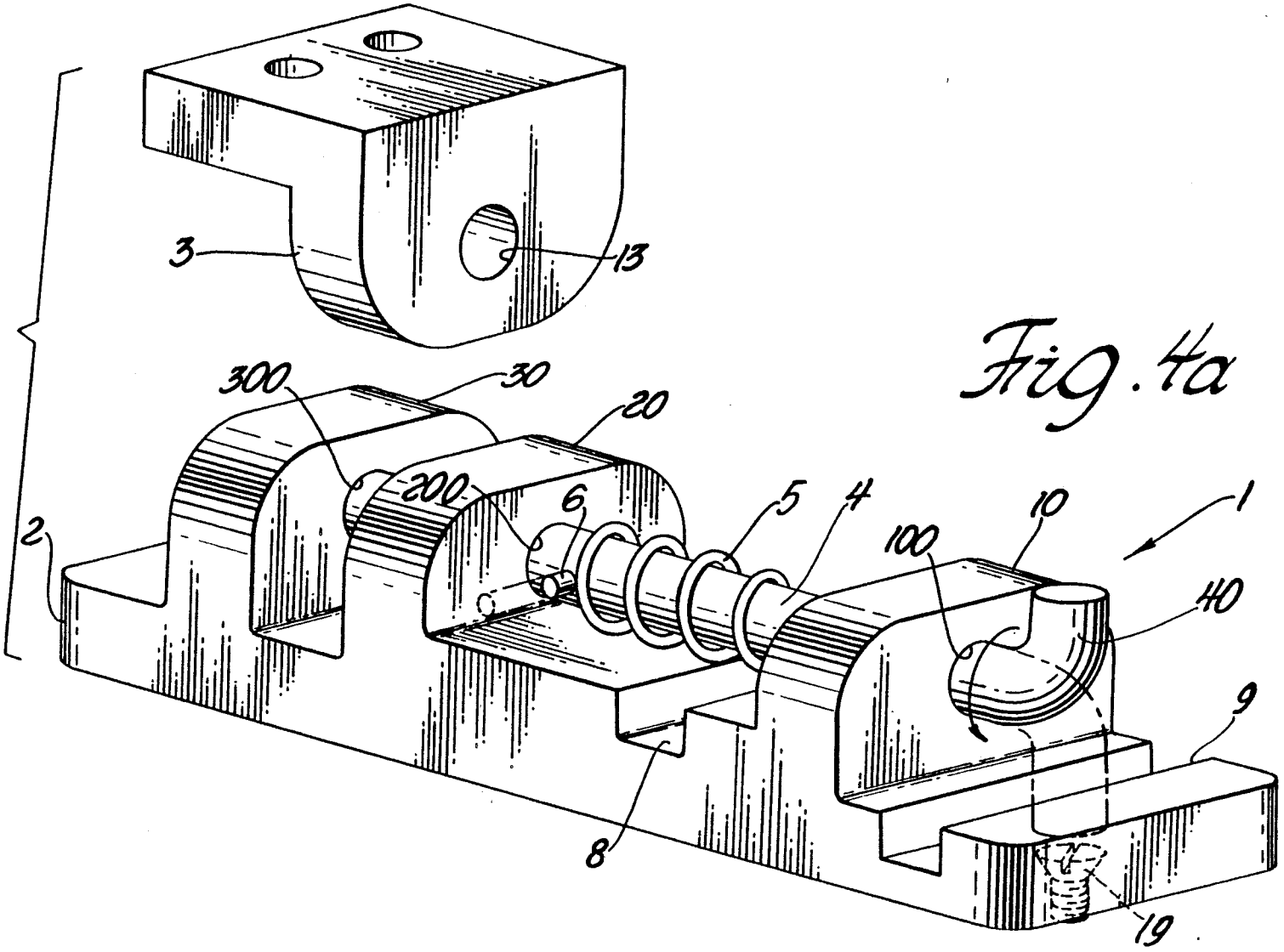
FIGS. 4*a* and 4*b* are perspective views of one modification of my mechanism.
Figure 4C:
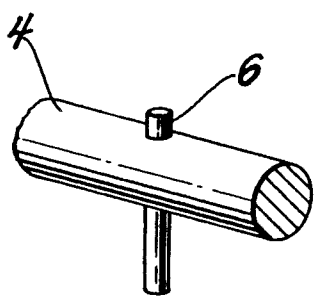
FIG. 4*c* is a detail view of the pin shown in FIG. 4*b*.
Figure 4B:
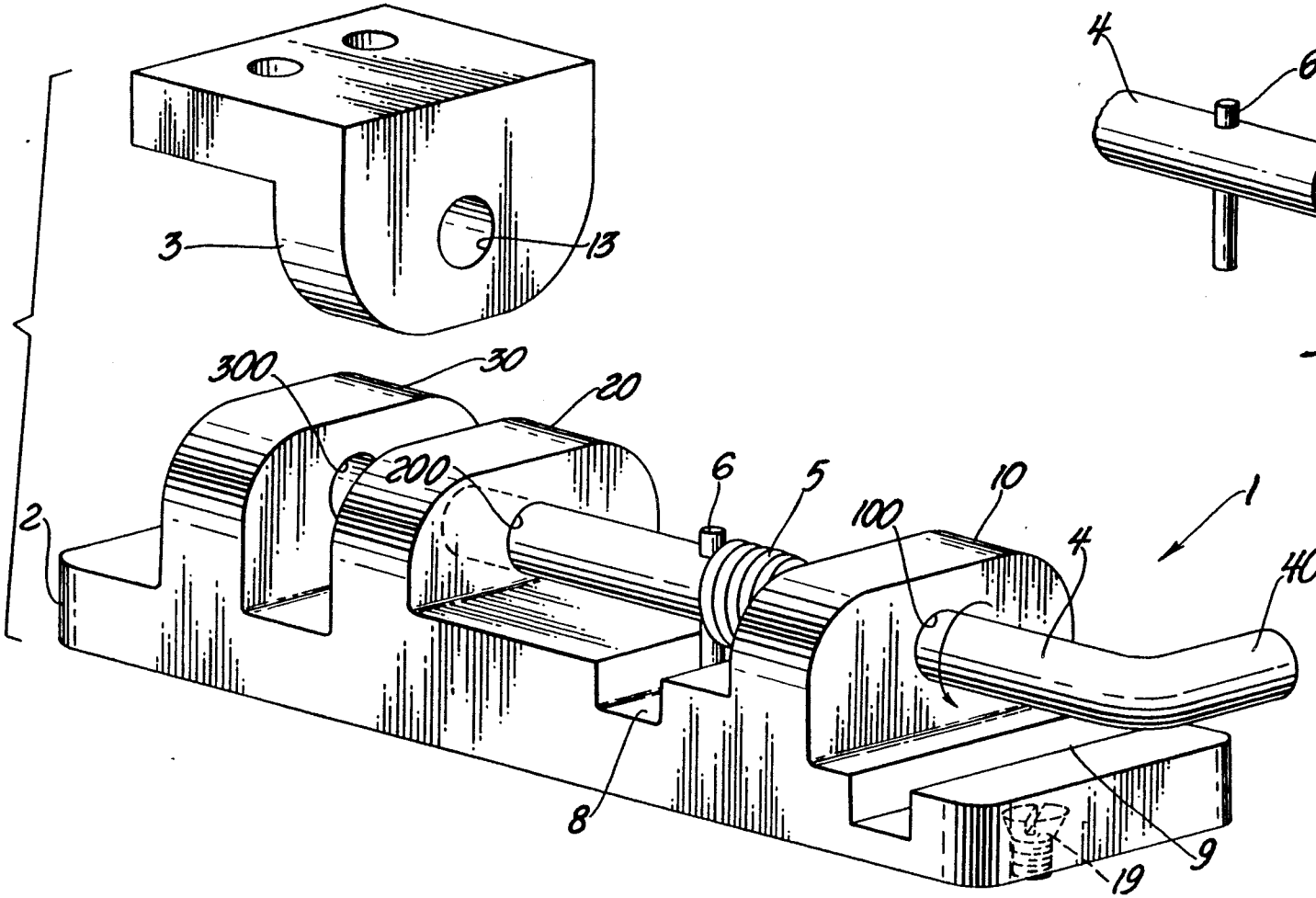

A possible modification to mechanism 1 is shown in FIGS. 4*a*, 4*b* and 4*c* wherein locking slot 7 is eliminated in favor of locking slot 9 and dowel 6 protrudes unequally from the sides of pin 4. In this modification, both pin handle 40 and slot 9 serve dual purposes. First, pin handle 40 facilitates translation or and rotation of pin 4 and further acts as a dowel to lock the pin in the engaged (leftward, flange holding) position. As seen in FIG. 4*a*, pin 4 is in a leftward, flange engaging position, with pin handle 40 pointing normally away from base 2. A counterclockwise half rotation of pin 4 turns handle 40 into locking slot 9, thereby locking pin 4 in the flange engaging position. Second, slot 9 not only operates as a locking slot for pin handle 40, but it also can be a mounting hole where screw 19 can be countersunk.

Dowel 6 protrudes unequally from the diametrically opposite sides of pin 4 as shown in FIG. 4*c*. The shorter end of the dowel extends toward the base during axial translation and rotation of the pin so that the dowel clears the base and allows such rotation or translation. In FIG. 4*c*, the short end of dowel 6 protrudes upwardly and the long end protrudes downwardly into locking slot 8 when pin 4 is locked in the disengaged (rightward, flange releasing) position. FIG. 4*a* shows that the short end of dowel 6 protrudes outwardly from the page when pin 4 is biased in the unlocked, engaged position. The phantom lines of FIG. 4*a* illustrate that when pin 4 is rotated 180 degrees counterclockwise into the locked, engaged position, the long end protrudes outwardly from the page.

Figure 5A:
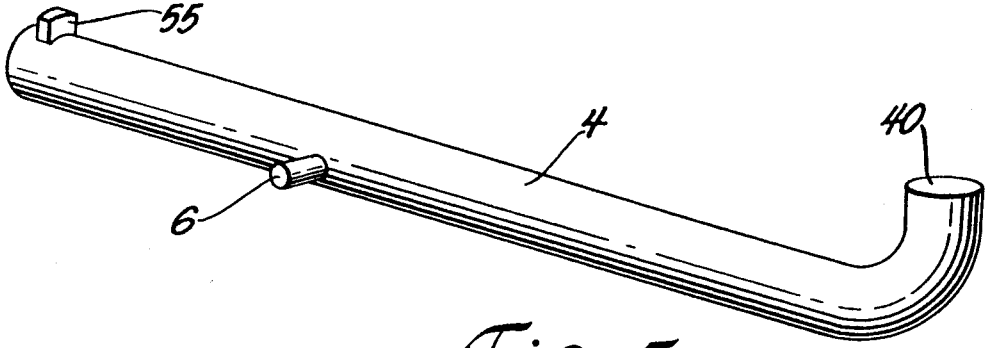
FIG. 5*a* is a detail view of the pin shown in FIG. 5.
Figure 5:
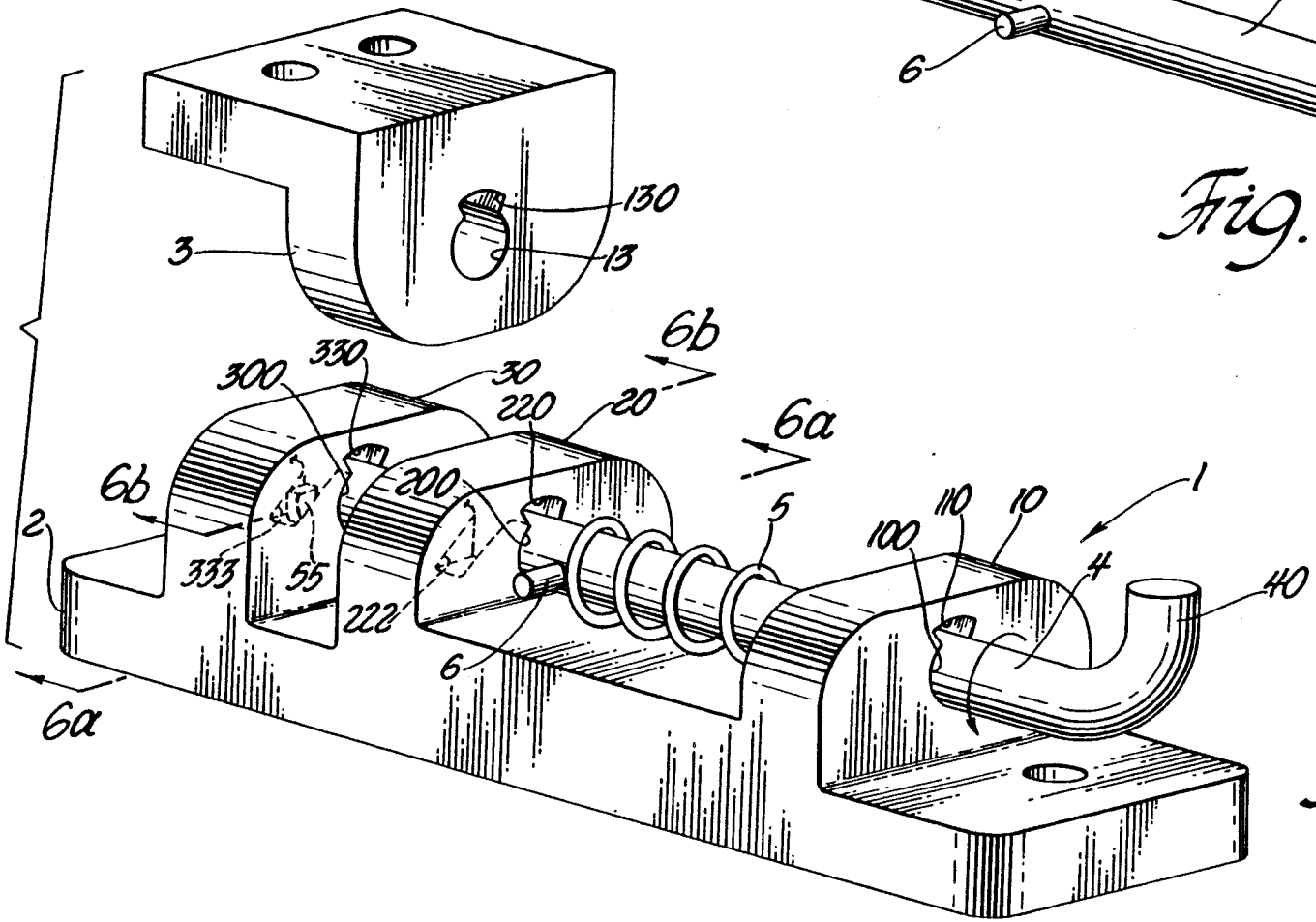
FIG. 5 is a perspective view of a second modification of my mechanism showing the grooved keyway locking design.
Figure 6A:
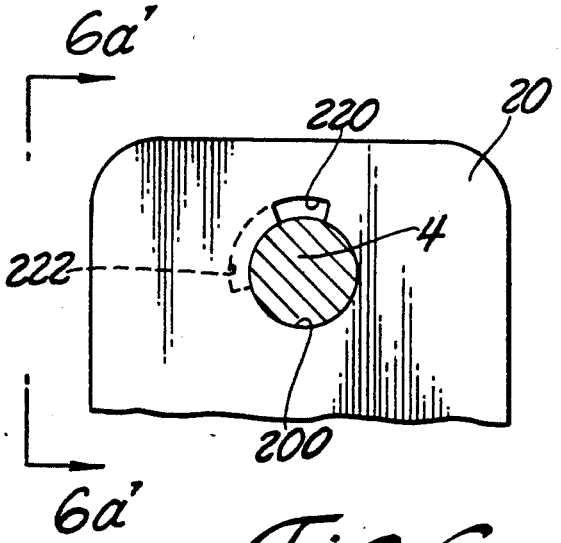
FIGS. 6*a* and 6*b* are sections taken along lines 6*a* —6*a* and 6*b* —6*b* in FIG. 5. These figures show details of the grooved keyway locking design and the two extensions of the hinge mechanism shown in FIG. 5.
Figure 6A:
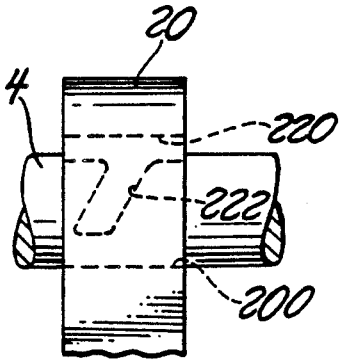
Figure 6B:
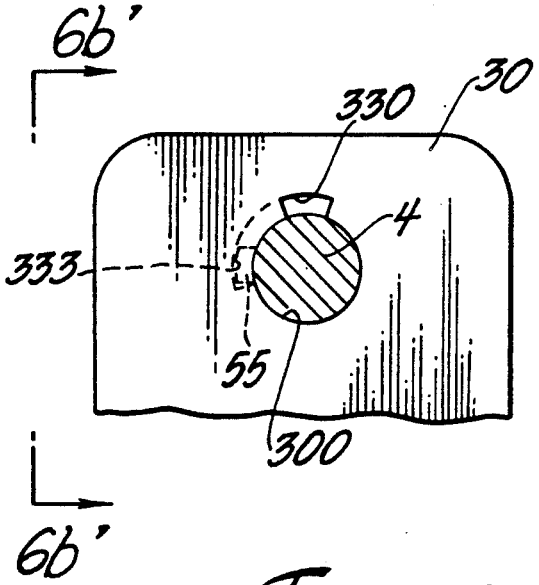
Figure 6B:
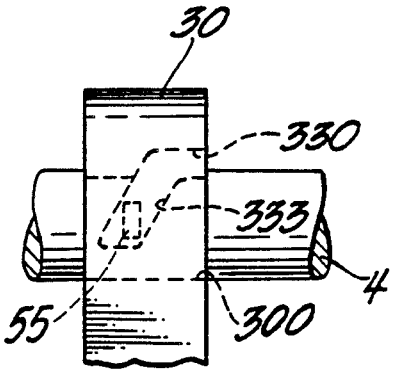

Another possible modification to mechanism 1 is shown in FIGS. 5, 5*a*, 6*a* and 6*b* wherein locking slots 7 and 8 have been eliminated in favor of a grooved keyway locking design. As shown in FIG. 5*a*, pin nub key 55 protrudes from the pin's cylindrical surface near the leftward end of pin 4. Key 55 is perpendicular to the axis of dowel 6 and parallel to pin handle 40. As shown in FIG. 5, each plate extension (10, 20, 30) and the flange 3 define a keyway grooved into the perimeter of their respective holes. The keyways (110, 220, 130, 330) are axially aligned and just wide and deep enough to allow passage of key 55. Additionally, extensions 20 and 30 each define a keystop grooved into their respective holes. As illustrated in FIGS. 6*a* and 6*b*, the keystops (222, 333) are short channels connected angularly to their respective keyways. As shown in FIG. 5, when pin 4 is in the engaged (leftward, flange holding) position, key 55 is situated within keyway 330 of extension 30. A counterclockwise quarter turn of pin 4 locks pin nub key 55 within keystop 333. Spring 5, which is under compression, biases key 55 to the left and downward in keystop 333, thereby locking pin 4 into the engaged position and preventing axial translation of pin 4. Similarly, when pin 4 is held in the disengaged (rightward, flange releasing) position, pin nub key 55 is within keyway 220 of extension 20. A counterclockwise quarter rotation of pin 4 locks key 55 within keystop 222, thereby locking pin 4 into the disengaged position and preventing axial translation. The grooved keyway locking design substitutes for the locking slots of FIG. 1.

The FIG. 5 embodiment keeps spring 5 compressed during both the engaged and disengaged positions. When pin 4 is in the engaged position shown in FIG. 5, spring 5 compresses dowel 6 toward but not to extension 20. As a result, key 55 is pressed against the back wall of keyway 330 of extension 30. Further the compression of spring 5 is all that is necessary to force the key into keystop 333 because of the keystop's angular intersection with keyway 330. See FIG. 6*b*. Both the shape of pin nub key 55 and the smoothness of the groove of keystop 333 are tailored to enhance this self-locking effect when pin 4 is set in the engaged position.

When pin 4 is pulled against the bias of spring 5 into the disengaged (rightward) position, key 55 must be aligned with keystop 222 of extension 20. A counterclockwise quarter rotation of pin 4 turns the key into keystop 222 and spring 5 positively locks it there. It is also noted that in the FIG. 5 embodiment, dowel 6 functions only to hold spring 5 in compression. Therefore, the dowel used in this embodiment is shorter than dowels required in the designs of FIGS. 1–4.

Figure 7A:
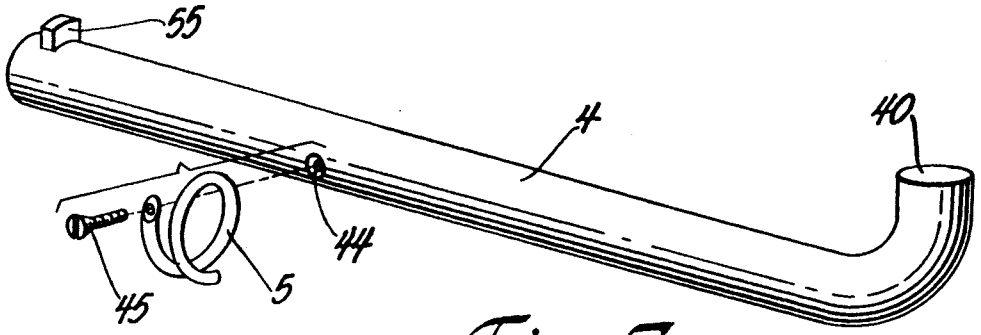
FIG. 7*a* is a detail view of the FIG. 7 pin and the pin nub key protruding from the surface of the pin.
Figure 7:
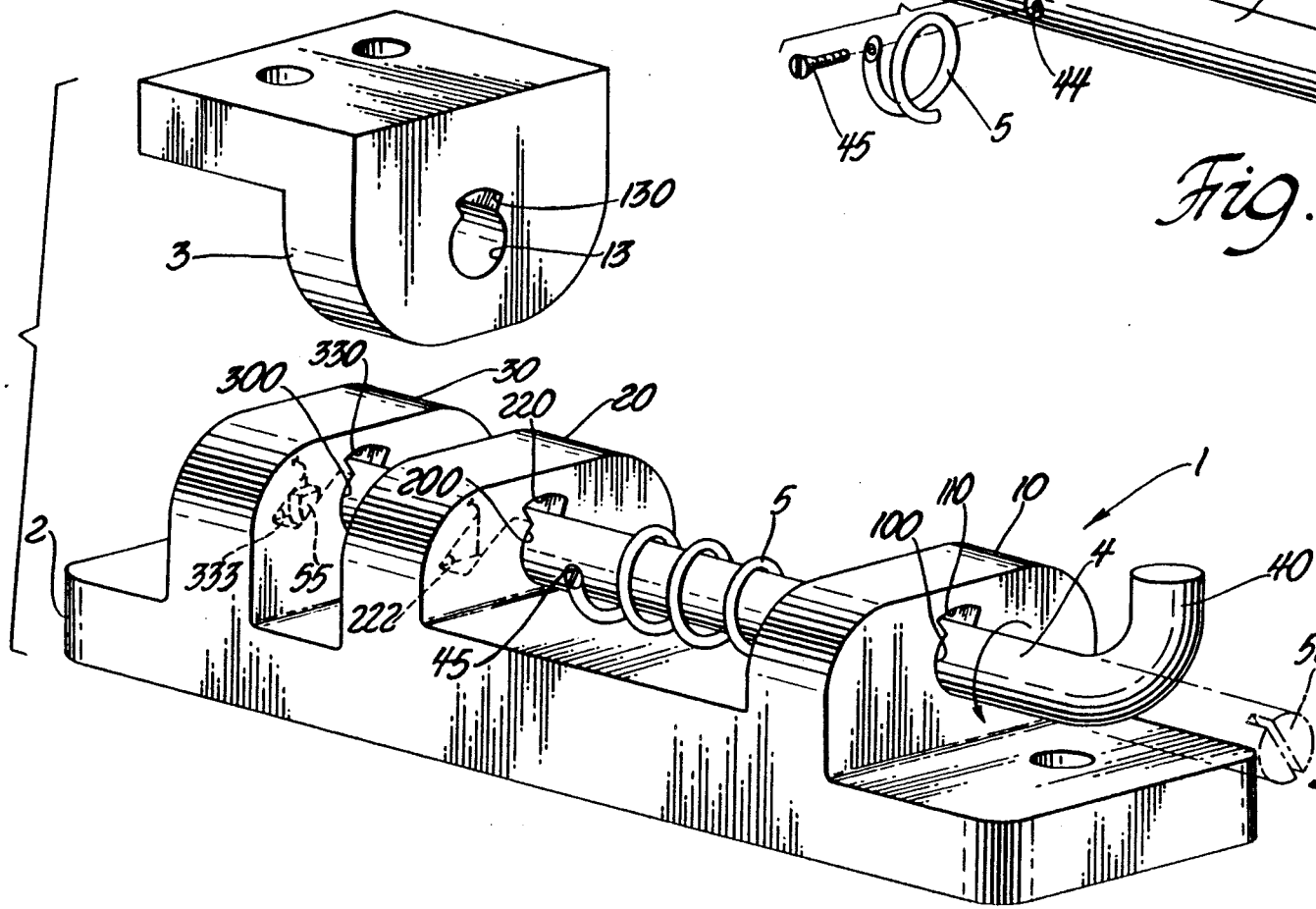
FIG. 7 is a perspective view of a third modification of my mechanism showing the pin in the engaged position.

FIGS. 7 and 7*a* show a variation of the design illustrated in FIGS. 5 and 6. In FIGS. 7 and 7*a*, dowel 6 has been replaced by screw 45, and spring 5 is in tension, not in compression. One end of spring 5 is fastened by screw 45 at hole 44 in pin 4. The other end of spring 5 is attached to extension 10. The spring's attachment point on extension 10 is chosen so that pin 4 must be rotated a clockwise quarter turn against the wind of spring 5 to align key 55 with keyways 220 and 330 of extensions 20 and 30. This permits axial translation of pin 4 and means that key 55 tends to unwind or snap into each keystop when inserted into a keyway. As a result, since spring 5 is in tension, pin 4 naturally rests in the disengaged (rightward, flange releasing) position with key 55 locked within keystop 222 of extension 20. From the locked, disengaged position, a clockwise quarter rotation of pin 4 winds spring 5 and releases key 55 from locking engagement within keystop 222 of extension 20. Pin 4 can then be translated toward extension 30 by pushing pin handle 40 against the increasing tension of spring 5. Once key 55 is pushed within keyway 330 of extension 30, spring 5 automatically unwinds a counterclockwise quarter rotation, thereby firmly locking key 55 into keystop 333 of extension 30. It will be seen that this modification of mechanism 1 can be set and locked in either the engaged or disengaged position. As an optional feature for this modification, screw head 50 (shown in phantom lines) instead of pin handle 40 can be incorporated onto the rightward end of pin 4.

I wish it to be understood that I do not desire to be limited to the exact details of the various constructions shown and described herein because obvious modifications may occur to those skilled in the relevant arts without departing from the scope of the following claims.

I claim:

1. A mechanism for releasably locking two or more objects which comprises:

(a) a base having a plurality of transverse ridges, each ridge defining a ridge hole such that the ridge holes are axially aligned with one another, the base being mountable to one of the objects;

(b) a flange dimensioned to fit closely between two of the ridges, the flange defining a flange hole axially alignable with and of equal diameter to the ridge holes, the flange being mountable to another of the objects;

(c) a pin axially translatable in the holes of the ridges and flange so that the flange is connectable to the base, the pin having a bias in a given axial direction;

(d) a means for effecting a change in the bias on the pin, the effecting means being movable relative to the pin so as to permit a change in bias on the pin without moving the pin relative to the base, the change in bias including the possibility of a change in direction of bias only, a change in strength of bias only or a change in both direction and strength of bias.

2. The locking mechanism of claim 1 wherein the flange defines a flat base engagement surface, the base engagement surface being faceable against the section of the base connecting two of the ridges, whereby the flange is fixedly connectable to the base.

3. The mechanism of claim 2 further comprising a handle connected normally to the pin.

4. The mechanism of claim 1 wherein the flange defines a rounded surface concentric with the axis of the pin so that the flange is pivotable about the pin.

5. The mechanism of claim 1 wherein the effecting means further comprises:

(a) a protruding member on the pin;

(b) a coil spring on the pin between two of the ridges, the protruding member extending between the coils of the spring such that rotation of the spring translates the spring relative to the pin.

6. The mechanism of claim 5 wherein the base defines two locking slots between the two ridges, one slot situated immediately adjacent to one of the two ridges, another slot spaced from the other of the two ridges, the protruding member engageable with the slots.

7. The mechanism of claim 1 wherein the biasing means further comprises:

(a) a dowel protruding outwardly unequal distances from diametrically opposite sides of the pin;

(b) a coil spring concentric with the pin between two of the ridges, the dowel protruding between the coils of the spring such that rotation of the spring translates the spring relative to the pin;

(c) the base defining a locking slot between the two ridges.

8. The locking mechanism of claim 1 wherein the biasing means further comprises:

(a) a dowel insertable through the pin, the dowel protruding outwardly equidistantly from diametrically opposite sides of the pin;

(b) an coil spring concentric with the pin and compressed between the dowel and one of the ridges, whereby axial translation of the pin from an engaged position to a disengaged position further compresses the spring;

(c) a pin nub key protruding normally from the pin's cylindrical surface near one end of the pin;

(d) the flange and each ridge defining a keyway at the perimeter of their respective through holes, the keyways being axially aligned with each other and dimensioned to permit passage of the pin nub key;

(e) the two ridges each defining a keystop grooved into the perimeter of its respective through hole, each keystop being angularly connected to the keyway and dimensioned to retain securely the pin nub key so that the pin may be locked in either the engaged or disengaged position.

9. The mechanism of claim 4 further comprising a handle connected at one end of the pin normally to the pin axis whereby the handle facilitates axial translation and rotation of the pin.

10. The mechanism of claim 9 wherein the effecting means further comprises:

(a) a dowel insertable through the pin, the dowel protruding outwardly equidistantly from diametrically opposite sides of the pin;

(b) a coil spring concentric with the pin between the two ridges, the dowel protruding between the coils of the spring such that rotation of the spring in one direction moves the spring relative to the pin, so that the bias on the pin toward an engaged position is increased and rotation of the spring in the opposite direction moves the spring relative to the pin so that the bias on the pin toward a disengaged position is increased.

11. The mechanism of claim 10 wherein the base defines two locking slots asymmetrically situated between two of the ridges, one slot situated immediately adjacent to one ridge, the other slot spaced from another ridge and towards the one slot, the dowel protruding into the one slot when the pin is locked in an engaged position, the dowel protruding into the other slot when the pin is locked in a disengaged position.

12. The positive locking mechanism of claim 9 wherein the biasing means further comprises:

(a) a dowel insertable into and firmly fastenable within a hole defined by the pin, the dowel protruding outwardly an equal distance from the diametrically opposite sides of the pin;

(b) a coil spring concentric with the pin between the dowel and one of the ridges, wherein axial translation of the pin form an engaged position to a disengaged position further compresses the spring;

(c) a pin nub key protruding normally from the pin's cylindrical surface near an opposite end of the pin;

(d) the flange and each ridge defining a keyway grooved into the perimeter of their respective holes, the keyways being axially aligned and dimensioned to permit passage of the pin nub key;

(e) the two ridges each defining a keystop grooved into the perimeter of its respective hole, each keystop being angularly connected to the keyway and dimensioned to securely retain the pin nub key, whereby the pin may be locked in either the engaged or disengaged position.

13. The mechanism of claim 1 wherein changing the bias on the pin increases the bias on the pin in one axial direction and thereby increases the bias on the pin toward an engaged position where the flange is locked to the base.

14. The mechanism of claim 13 wherein the effecting means is moveable relative to the pin so as to change the bias of the pin in the opposite axial direction, whereby the pin is biased away from the engaged position.

* * * * *